United States Patent [19]

Millon-Fremillon et al.

[11] Patent Number: 4,671,593

[45] Date of Patent: Jun. 9, 1987

[54] MICROCONNECTOR WITH HIGH CONTACT DENSITY

[75] Inventors: Bruno Millon-Fremillon, Grenoble; Gérard Nicolas, Voreppe, both of France

[73] Assignee: Commissariat a l'Energie Atomique, Paris, France

[21] Appl. No.: 756,296

[22] Filed: Jul. 18, 1985

[30] Foreign Application Priority Data

Jul. 27, 1984 [FR] France ..... 84 11985

[51] Int. Cl.[4] ..... H01R 9/09

[52] U.S. Cl. ..... 439/326; 439/77; 439/629

[58] Field of Search ..... 339/17 F, 75 MP, 75 M, 339/176 MF, 176 MP

[56] References Cited

U.S. PATENT DOCUMENTS

| | | | |
|---|---|---|---|
| 3,629,787 | 12/1971 | Wilson | 339/17 F |
| 3,638,033 | 1/1972 | Johnson et al. | 339/176 MP |
| 3,663,925 | 5/1972 | Proctor | 339/65 |
| 4,060,889 | 12/1977 | Zielinski | 339/17 F |
| 4,072,387 | 2/1978 | Sochor | 339/176 MF |
| 4,477,137 | 10/1984 | Ayer | 339/17 F |

FOREIGN PATENT DOCUMENTS

| | | |
|---|---|---|
| 677995 | 9/1966 | Belgium . |
| 2204941 | 5/1974 | France . |
| 2475809 | 8/1981 | France . |

OTHER PUBLICATIONS

Machine Design, vol. 54, No. 11, May 1982, pp. 255-277, Cleveland, US, "Section 8 Interconnections", p. 267, column 3, lines 11-17-p. 268, column 1, lines 12-23 .

*Primary Examiner*—John McQuade

[57] ABSTRACT

A microconnector is used for connecting electrodes placed on a support and which are insulated from one another to the same number of conductors as there are electrodes and comprises a means for the elastic gripping of the support and flexible, elastic conductor wires, whose number is the same as that of the electrodes for connecting to the latter, which are insulated from one another and from the gripping means and which are fixed to the latter in such a way that each of them can come into contact with a single electrode when the support is gripped by the gripping means. Application is to low temperature electrical connections and to high density connections in a reduced space.

6 Claims, 1 Drawing Figure

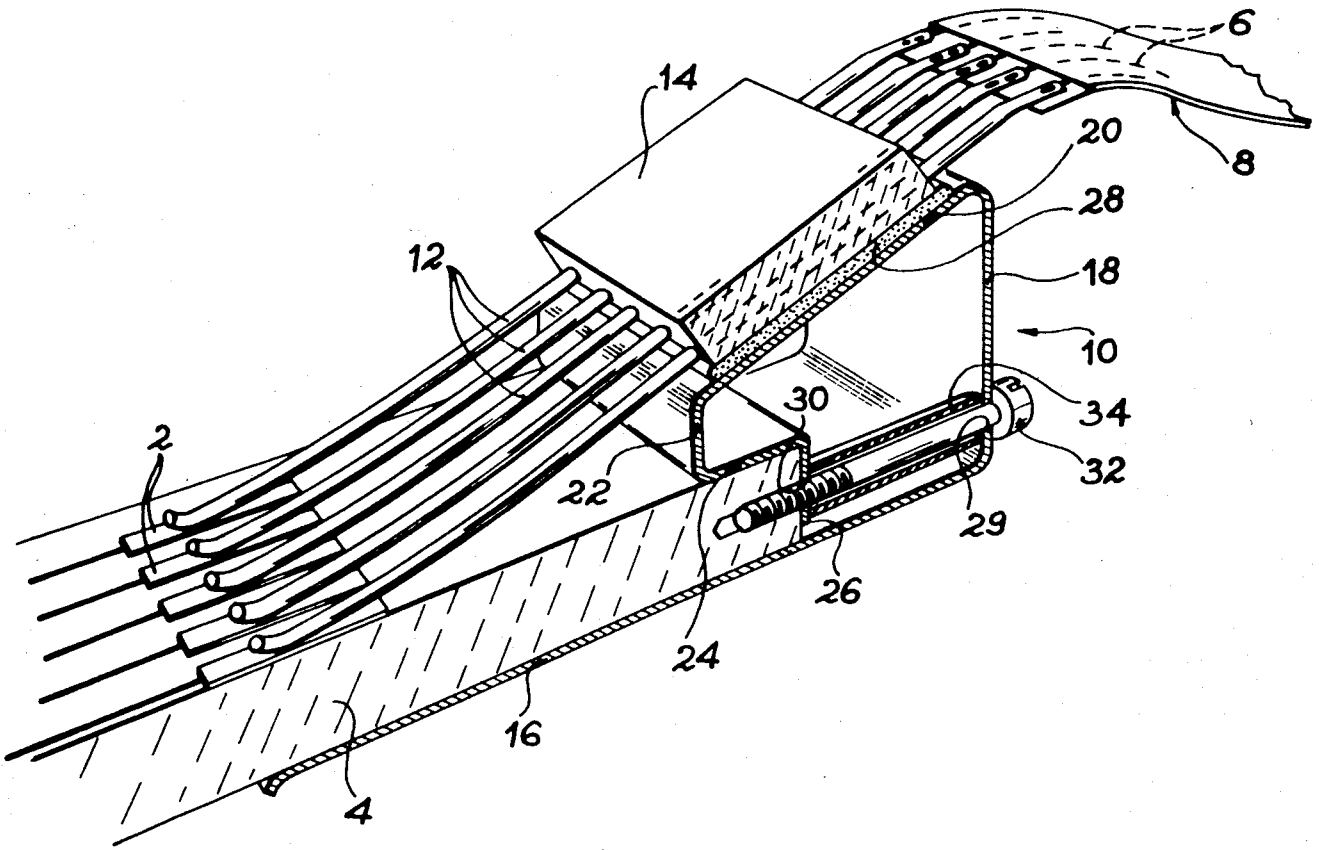
6
8
20
28
18
10
34
32
29
26
30
24
14
22
16
12
4
2

MICROCONNECTOR WITH HIGH CONTACT DENSITY

BACKGROUND OF THE INVENTION

The present invention relates to a microconnector with high contact density. It more particularly applies to low temperature electrical connections and, in the field of electronics and microelectronics, to high density miniaturised circuit connections. The Prior Art connectors making it possible to establish contacts between electrical conductors suffer from the following disadvantages. They only make it possible to obtain a limited contact density between the conductors and at the best a few dozen separate contacts with a spacing of approximately 1 mm, they occupy a significant volume, generally have a complicated structure with moving parts and a relatively high mass, so that they are unsuitable for use in a cryogenic environment and in a reduced space.

SUMMARY OF THE INVENTION

The object of the present invention is to obviate the aforementioned disadvantages.

The present invention therefore specifically relates to a microconnector for connecting electrodes arranged on a support and electrically insulated from one another, to electrical conductors, which are present in the same number as the electrodes, wherein it comprises a means for elastically gripping the support and flexible, elastic electrically conductive wires, whose number equals that of the electrodes and which are to be respectively connected to the latter by one end and to the electrical conductors by the other end, which are electrically insulated from one another and from the gripping means, whilst being made rigidly integral with the latter, in such a way that each of them can come into contact with a single electrode when the support is gripped by the gripping means.

The design of the microconnector according to the invention makes it possible to obtain a high contact density. This microconnector has few parts and requires no moving parts. It is therefore very reliable, easy to use and inexpensive. Moreover, it can be produced in such a way that it is very light, has limited overall dimensions and is consequently suitable for use in a cryogenic environment and where space is limited. Finally, bearing in mind the small number of parts, this microconnector can easily be used in vacuo, because it is only subject to limited degassing. Preferably, the wires are made from an alloy of copper and beryllium.

Such wires are commercially available and can be used as they are, except for a limited curvature carried out at one of their ends. Thus, there is no need for any intermediate pre-shaped and prefabricated contact part, the actual wires serving to produce the contacts and improving the latter, as a result of their flexibility and elasticity. The gripping, clamping or squeezing means can be made from beryllium bronze.

According to a special embodiment of the microconnector according to the invention, the wires are made rigidly integral with one another by means of an electrically insulating part, fixed to the gripping means and thermally insulated therefrom.

Finally, according to another special embodiment, the gripping means is provided with at least one perforation for the passage of a screw for fixing the support to the gripping means.

DESCRIPTION OF THE DRAWING AND THE PREFERRED EMBODIMENT

The present invention is described in greater detail hereinafter relative to a non-limitative embodiment and with reference to the attached drawing, in which said embodiment is diagramatically shown in longitudinal sectional form.

The microconnector diagramatically shown in the drawing serves to connect electrodes 2 present on one face of an electrically insulating support 4 to electrical conductor 6, whose number is the same as that of the electrodes.

Electrodes 2 can be parallel to one another and regularly spaced from one another on support 4, which can e.g. be constituted by a glass plate. Conductor 6 can form part of a known flexible circuit 8 having said conductors arranged parallel to one another between two plastic sheets.

The microconnector diagrammatically shown in the drawing comprises a means 10 for the elastic gripping of support 4 and wires 12 formed from a copper and beryllium alloy and rendered rigidly integral with one another by an electrically insulating part 14, fixed to the gripping means 10 and thermally insulated therefrom. Part 14 can be produced by moulding a plastic material directly around wires 12. Part 14 can also be constituted by a plastic bar having not shown transfer grooves in which are respectively immobilized the wires 12, e.g. by adhesion.

Wires 12 are immobilized by means of part 14, in such a way that each of them can come into contact with a single electrode 2. When the electrodes are parallel, the wires can be arranged parallel to one another.

The gripping means 10 is made from a material having a good coefficient of elasticity at low temperature, e.g. beryllium bronze. It is machined in the mass with the aid of a digital wire cutting machine. The thickness of gripping means 10 can be approximately 0.3 mm.

The structure of the gripping means 10, as shown in the drawing comprises a first face 16 on which can be placed one of the faces of support 4; a second face 18 forming an angle of approximately 90° with the first face 16; a third face 20 forming an acute angle with the second face 18 and directed towards the first face 16; a fourth face 22 forming an obtuse angle with the third face 20 and oriented towards the first face 16; a fifth face 24 parallel to the first face 16 and directed towards the second face 18; and a sixth face 26 substantially perpendicular to the first face 16 and directed towards the latter.

The gap between the first face 16 and the fifth face 24 receives support 4. Part 14 is fixed to face 20 by means of a thermally insulating adhesive layer 28, the adhesive being e.g. of the type marketed under the trade mark CAF or the trade mark ECOBON. Part 14 is fixed to face 20 in such a way that the wires 12 extend in the direction of face 16, so that they can be applied by their ends to electrodes 2, when the face of support 4 not carrying electrodes 2 is positioned against face 16.

Obviously the dimensions of gripping means 10 and part 14 are a function of the number of wires 12, the spacing thereof and the thickness of support 4.

The dihedron formed by faces 18 and 20 determines the bearing force of wires 12 on electrodes 2 and consequently the gripping force of the gripping means 10.

Face 26 serves as a positioning abutment for the assembly formed by gripping means 10, part 14 and wires 12.

It is consequently possible to produce a microconnector, whose weight does not exceed 0.5 g and whose volume is approximately 0.5 to 0.6 $cm^3$, said microconnector being provided with 37 connecting wires 12, whereof the diameter is approximately 100 μm and whereof the spacing is approximately 400 μm.

The placing of support 4 in the microconnector is carried out in the following way. Support 4 is firstly slid between wires 12 and face 16, the wires 12 being parallel to support 4 in said first stage. Appropriate transverse translation of the gripping means 10 are carried out so as to appropriately position wires 12 face electrodes 2, which is possible without a binocular magnifier. The gripping means 10 then performs a rotary movement about an axis perpendicular to the direction of wires 12, during said stage support coming into contact with the first face 16, the elastic wires 12 then exerting their pressure on electrodes 2. Finally, support 4 is displaced in translation, so as to abut against face 26. Thus, support 4 is gripped between the elastic wires 12 and face 16.

The ends of wires 12 in contact with these electrodes can be curved in a direction moving them away therefrom, so that the electrodes are not damaged.

The other ends of wires 12 pass beyond part 14 and are respectively connected to conductor 6. In the case where the latter form part of the aforementioned circuit 8, the electrical connection between the wires and the conductors can be made in the following way. One of the plastic sheets is removed over a certain length from the end of circuit 8, which exposes the ends of conductor 6 and the wires 12 are then respectively welded to conductor 6, e.g. by a Sn/Pb weld.

Particularly in the case where support 4 is thick, e.g. in the case of a computer card provided with a certain number of electronic circuits and connection electrodes to said circuits, the support 4 can be locked in the microconnector. This can be carried out by providing corresponding openings 29, 30, respectively in faces 18, 26 of gripping means 10, so that it is possible to immobilize support 4 relative to the microconnector with the aid of a screw 32, which is screwed into support 4, whilst traversing openings 29, 30 and whose head bears against the face 18 of the gripping means. If a significant tightening action is necessary so as not to crush the face 18 of the gripping means 10 during the tightening of screw 32, a tubular spacer 34 is provided between openings 29 and 30 and is traversed by the screw.

According to a constructional variant, part 14 is eliminated and wires 12 are directly embedded in an electrically and thermally insulating adhesive coating, placed on face 20 of gripping means 10.

What is claimed is:

1. A microconnector for connecting electrodes arranged on a support and electrically insulated from one another to electrical conductors which correspond to the electrodes, the support including an upper surface, a lower surface and an edge, the electrodes being located on the upper surface and terminating at a location spaced from the edge to define a gap between the end of each electrode and the support edge, comprising:

a gripping body having gripping means for gripping onto the support adjacent to the support edge and abutting means for abutting the support edge, said gripping body further including a mounting face which is spaced from the support upper surface and which is angled with respect to the support upper surface when said gripping means grips onto the support; and a plurality of wire means for electrically connecting one of the electrical conductors to the corresponding electrode, said wire means being mounted on said gripping body mounting face and each having one end spaced outwardly away from the support edge, said wire means extending substantially parallel to said gripping body mounting face in the vicinity of said face past the electrode ends and being angled with respect to the support upper surface, each of said wire means having another end engaging the corresponding electrode and being substantially linear between said ends, said wire means being biased to press against the electrodes to make electrical contact therewith when said gripping means grips onto the support.

2. A semiconductor according to claim 1, wherein the wire means are flexible elastic wires made from a copper and beryllium alloy.

3. A microconnector according to claim 1, wherein the gripping body is made from beryllium bronze.

4. A microconnector according to claim 1, wherein the wire means are made rigidly integral with one another by an electrically insulating part, fixed to the gripping body and thermally insulated therefrom.

5. A microconnector according to claim 1, wherein the gripping body is provided with at least one opening used for the passage of a screw for fixing the support to the gripping body.

6. A microconnector according to claim 2, wherein said wires have a portion thereof which is not covered by insulation and a contact part which is not preshaped or prefabricated.

* * * * *